US005727834A

United States Patent [19]

Weselowski

[11] Patent Number: 5,727,834

[45] **Date of Patent: *Mar. 17, 1998**

[54] SAFETY ATTACHMENT FOR A LIFTING HOOK

[76] Inventor: James Weselowski, 539 Archibald Street, Winnipeg, Manitoba, Canada, R2J 0X3

[21] Appl. No.: 810,335

[22] Filed: Feb. 27, 1997

Related U.S. Application Data

[60] Provisional application No. 60/013,927, Mar. 22, 1996.

[51] Int. Cl.[6] ..... B66C 1/36

[52] U.S. Cl. ..... 294/82.19

[58] Field of Search ..... 294/82.17, 82.19, 294/82.2, 82.21, 82.23, 82.31; 24/599.1, 599.4, 599.8

[56] References Cited

U.S. PATENT DOCUMENTS

| | | | |
|---|---|---|---|
| 1,667,957 | 5/1928 | Stevenson | 294/82.21 |
| 1,711,440 | 4/1929 | Baker | 294/82.2 |
| 1,794,694 | 3/1931 | Jensen et al. | 294/82.19 |
| 2,492,991 | 1/1950 | Hanna | 24/599.6 |
| 3,008,210 | 11/1961 | Stovern | 294/82.19 |
| 4,193,627 | 3/1980 | Cranston et al. | 294/82.19 |
| 4,195,872 | 4/1980 | Skaalen et al. | 294/82.19 |
| 4,293,156 | 10/1981 | Chapalain | 294/82.21 |

*Primary Examiner*—Johnny D. Cherry
*Attorney, Agent, or Firm*—Adrian D. Battison; Murray E. Thrift

[57] ABSTRACT

A safety attachment for a lifting hook comprises a handle attached to the hook at one leg of the hook and a trigger pivotally mounted on the handle and operable such that the latch of the hook is pulled open by operating the trigger. The handle comprises a bar generally parallel to the one leg of the hook with the trigger being pivotally mounted adjacent a bottom end of the bar and extending in front of the bar for grasping by the hand simultaneously with the bar. A wire loop extends between a top of the trigger and a part of the latch and passes around both sides of the one leg of the hook. The handle and trigger allow the hook to be manipulated and operated by the user without touching the hook in the area of the heavy object to be engaged onto the hook.

8 Claims, 1 Drawing Sheet

SAFETY ATTACHMENT FOR A LIFTING HOOK

This application claims the benefit of U.S. provisional application No. 60/013,927, filed Mar. 22, 1996.

BACKGROUND OF THE INVENTION

This invention relates to a safety attachment for a lifting hook.

The safety attachment is of the type which can be attached to an existing lifting hook of the type comprising a top loop for support of the hook, a generally U shaped hook suspended from the loop and defining two legs one of which is attached to the loop and the other of which is spaced away from the loop to define an open mouth and a spring operated, pivotal latch having one end pivotally mounted on said one leg and extending across the open mouth to prevent exit of an element suspended on the hook.

The safety attachment allows the hook to be grasped by the hand of a user without contacting the hook itself and at the same time allows the latch to be pulled open. Thus the hook can be manipulated without the danger of the fingers of the operator becoming engaged between the hook and an element suspended on the hook.

SUMMARY OF THE INVENTION

According to one aspect of the invention there is provided a safety attachment for a lifting hook, the lifting hook comprising a top loop for support of the hook, a generally U-shaped hook suspended from the loop and defining two legs of the hook one of which is attached to the loop and the other of which is spaced from the loop to define an open mouth and a spring operated, pivoting latch having one end pivotally mounted on said one leg and extending across the open mouth to prevent exit of an element suspended on the hook, the safety attachment comprising a bracket clamped onto the hook at said one leg defining a handle by which the hook can be grasped, a trigger pivotally mounted on the bracket and operable by a hand grasping the handle and means interconnecting the trigger and the latch such that the latch is pulled open by operating the trigger.

Preferably the handle comprises a bar generally parallel to said one leg of the hook with the trigger being pivotally mounted adjacent a bottom end of the bar and extending in front of the bar for grasping by the hand simultaneously with the bar.

Preferably the bracket includes a bottom rail and a top rail connecting the bar to the hook and a clamping bar generally parallel to the handle bar with the clamping bar being clamped to the hook.

Preferably the clamping bar is shaped so as to follow the periphery of the hook and a part of the loop.

Preferably the clamping bar includes a V-shaped portion extending into a neck between the loop and the hook.

Preferably there is provided a clamp having a strap wrapped around said one leg of the hook and engaging the clamping bar on opposed sides thereof.

Preferably the interconnecting means comprises a wire loop extending between a top of the trigger and a part of the latch with a wire loop passing around both sides of said one leg of the hook.

One embodiment of the invention will now be described in conjunction with the accompanying drawings in which:

DETAILED DESCRIPTION

Figure 1:
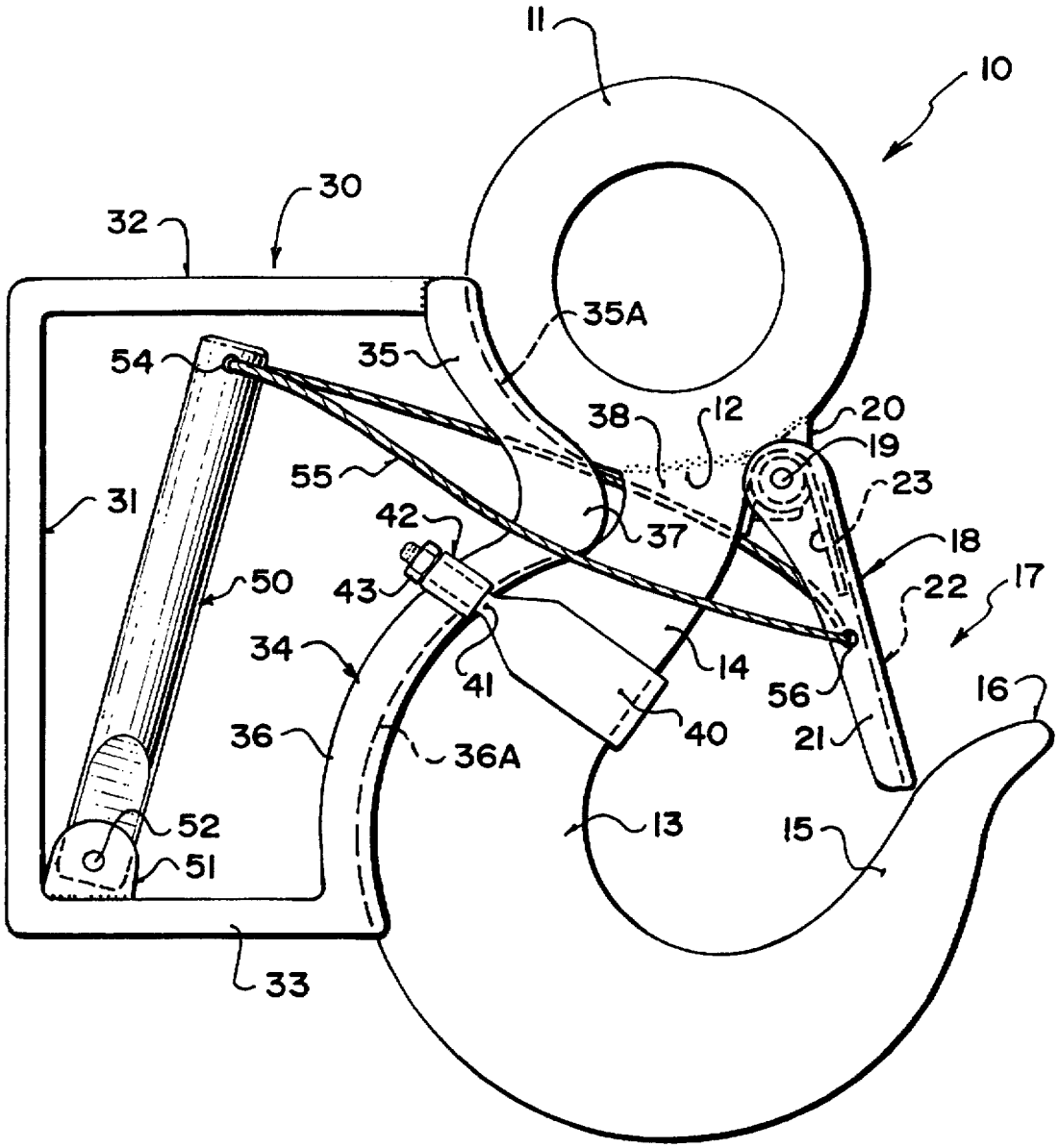
FIG. 1 is a side elevational view of a hook and safety attachment according to the present invention

A conventional hook is generally indicated at 10 and includes an upper loop 11 for attachment to a support for example the cable of a crane, a winch or the like. At a bottom surface 12 of the loop is welded a hook portion 13 having a first leg 14 the top of which is welded to the bottom 12 of the loop and a second leg 15 thus forming a generally U-shape for confining an element to be suspended between the legs of the hook. The leg 15 includes an upper generally pointed nose 16 with the nose defining with the upper part of the leg 14 an open mouth generally indicated at 17. The open mouth is closed by a latch member 18. The latch member 18 is pivotally mounted on a pin 19 extending through a lug 20 welded between the underside of the loop 11 and the front face of the leg 14. The latch 18 includes two sides 21 which depend from a top plate 22. Each of the sides 21 has a wider upper end for engaging respective sides of the lug 20 and receiving the pin 19 therethrough. The latch 18 is spring biased into a closed position engaging the inner face of the leg 15 by a spring 23 wrapped around the pin.

The safety attachment of the present invention comprises a bracket generally indicated at 30 defining a handle bar 31 which is generally vertical and generally parallel to the outside face of the leg 14 and the adjacent portion of the loop 11. The bar is formed of a thin strap of metal having a width of the order of one inch and a thickness of the order of ¼ inch. At the top end of the handle bar 31, the same strap of metal is bent at right angles to form a top rail 32. At the bottom of the handle bar 31 the same strap of metal is bent again horizontal to form a bottom rail 33. The top and bottom rails are attached to the hook by a front bar 34 which is shaped to follow the adjacent portion of the loop 11 and the adjacent outside surface of the leg 14 of the hook 13. The bar 34 thus includes an upper portion 35 which is curved around the loop 11. The bar 34 includes a lower portion 36 which is curved around the outer surface of the leg. Both of these portions are transversely grooved so as to define a recess or groove 35A, 36A which receives the edge of the respective hook portion within the groove with sides of the bar extending just below the edge of the hook to hold the hook in place. The bar 34 thus defines a V-shaped section 37 between the upper and lower portions which engages into a neck 38 between the hook leg 14 and the periphery portion 12 of the loop 11.

The bar 34 is attached to the hook by a strap 40 which is generally U-shaped with a pair of legs each extending across a respective side of the leg 14. The strap is attached to a pair of bolts 41 each of which engages through a sleeve 42 welded on a side of the bar 34. Each bolt has a threaded end receiving a nut 43 thus clamping the strap 40 to the sleeves 42 to hold the bar 34 in place on the back of the hook.

A trigger 50 is mounted within the bracket in front of the handle bar 31 and is pivotally mounted in a clevice 51 welded to the bottom rail 33 and standing upwardly therefrom. The clevice includes a pin 52 which passes through the elongate bar forming the trigger 50 so the bar 50 can pivot forwardly and rearwardly in front of the handle bar 31. The bar 50 has a length substantially equal to the length of the handle bar so that the trigger can be grasped at any point along the length of the handle bar simultaneously with the grasping of the handle bar.

The trigger 50 has an upper hole 54 receiving a wire loop 55 which wraps around each side of the leg 14 of the hook and engages through a similar hole 56 formed in the sides of the latch 17. The wire loop is relatively stiff so that it holds the trigger forwardly in the bracket when the latch is closed by the action of the spring. However the trigger can be actuated simultaneously with grasping of the handle bar to open the latch for engagement of the hook onto an element suspended or from release from the hook from the element.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A combination of a lifting hook and a safety attachment therefor comprising:

a lifting hook having:

a top loop and a generally U-shaped hook member suspended from the loop and defining two legs of the hook member one of which is attached to the loop and the other of which is spaced from the loop to define an open mouth;

and a spring operated, pivoting latch having one end pivotally mounted on said one leg and extending across the open mouth to prevent exit of an element suspended on the hook member;

and a safety attachment having:

a bracket clamped onto the hook at said one leg defining a handle by which the lifting hook can be grasped;

a trigger pivotally mounted on the bracket and operable by a hand grasping the handle;

and means interconnecting the trigger and the latch such that the latch is pulled open by operating the trigger;

wherein the bracket comprises:

a handle bar generally parallel to said one leg of the hook member with the trigger being pivotally mounted adjacent one end of the bar and extending in front of the handle bar for grasping by the hand simultaneously with the bar;

a bottom rail and a top rail each extending from the handle bar to the hook member;

and a clamping bar generally parallel to the handle bar with the clamping bar being clamped to the hook member.

2. The safety attachment according to claim 1 wherein the clamping bar is shaped so as to follow the periphery of the hook member and a part of the loop.

3. The safety attachment according to claim 2 wherein the clamping bar includes a V-shaped portion extending into a neck between the loop and the hook member.

4. The safety attachment according to claim 1 wherein there is provided a clamp having a strap wrapped around said one leg of the hook member and engaging the clamping bar on opposed sides thereof.

5. The safety attachment according to claim 1 wherein the trigger is pivotally connected to the handle bar at a bottom end thereof and wherein the interconnecting means comprises a wire loop extending between a top of the trigger and a part of the latch with the wire loop passing around both sides of said one leg of the hook member.

6. A combination of a lifting hook and a safety attachment therefor comprising:

a lifting hook having:

a top loop and a generally U-shaped hook member suspended from the loop and defining two legs of the hook member one of which is attached to the loop and the other of which is spaced from the loop to define an open mouth;

and a spring operated, pivoting latch having one end pivotally mounted on said one leg and extending across the open mouth to prevent exit of an element suspended on the hook member;

and a safety attachment having:

a bracket clamped onto the hook at said one leg defining a handle by which the lifting hook can be grasped;

a trigger pivotally mounted on the bracket and operable by a hand grasping the handle;

and means interconnecting the trigger and the latch such that the latch is pulled open by operating the trigger;

wherein the bracket comprises:

a handle bar generally parallel to said one leg of the hook member with the trigger being pivotally mounted adjacent one end of the bar and extending in front of the handle bar for grasping by the hand simultaneously with the bar;

at least one rail extending from the handle bar to the hook member;

and a clamping bar generally parallel to the handle bar with the clamping bar being clamped to the hook member, the clamping bar being shaped so as to follow the periphery of the hook member and a part of the loop and including a V-shaped portion extending into a neck between the loop and the hook member.

7. The safety attachment according to claim 6 wherein there is provided a clamp having a strap wrapped around said one leg of the hook member and engaging the clamping bar on opposed sides thereof.

8. The safety attachment according to claim 6 wherein the trigger is pivotally connected to the handle bar at a bottom end thereof and wherein the interconnecting means comprises a wire loop extending between a top of the trigger and a part of the latch with the wire loop passing around both sides of said one leg of the hook member.

* * * * *